US005279902A

United States Patent [19]

Materkowski

[11] Patent Number: 5,279,902

[45] Date of Patent: * Jan. 18, 1994

[54] AIR HARDENING STEEL

[75] Inventor: James P. Materkowski, Latrobe, Pa.

[73] Assignee: Kennametal Inc., Latrobe, Pa.

[ * ] Notice: The portion of the term of this patent subsequent to Mar. 10, 2009 has been disclaimed.

[21] Appl. No.: 802,025

[22] Filed: Dec. 3, 1991

Related U.S. Application Data

[62] Division of Ser. No. 513,705, Apr. 24, 1990, Pat. No. 5,094,923.

[51] Int. Cl.[5] ..... C22C 38/44

[52] U.S. Cl. ..... 428/614; 420/108; 148/335; 148/328

[58] Field of Search ..... 420/108; 146/335, 328; 428/614

[56] References Cited

U.S. PATENT DOCUMENTS

| | | | |
|---|---|---|---|
| 2,327,490 | 8/1943 | Bagsar | 196/133 |
| 2,379,988 | 7/1945 | Post et al. | 420/108 |
| 2,565,953 | 8/1951 | De Gaspari | 420/108 |
| 2,791,500 | 5/1957 | Foley et al. | 420/108 |
| 3,379,582 | 4/1968 | Dickinson | 420/108 |
| 3,600,160 | 8/1971 | Simcoe et al. | 420/108 |
| 3,690,868 | 9/1972 | James et al. | 420/108 |
| 3,970,448 | 7/1976 | Wilson, Jr. et al. | 420/108 |
| 4,216,014 | 8/1980 | Horiuchi et al. | 420/108 |
| 4,344,018 | 8/1982 | Kunitake et al. | 420/108 |
| 4,483,722 | 11/1984 | Freeman | 420/108 |
| 4,527,987 | 7/1985 | Berchem | 420/108 |
| 4,650,645 | 3/1987 | Kato et al. | 420/108 |
| 4,729,872 | 3/1988 | Kishida et al. | 420/108 |
| 5,094,923 | 3/1992 | Materkowski | 420/108 |

FOREIGN PATENT DOCUMENTS

| | | | |
|---|---|---|---|
| 124938 | 7/1987 | Czechoslovakia . | |
| 1046647 | 12/1958 | Fed. Rep. of Germany | 420/108 |
| 1591002 | 5/1970 | France | 420/108 |
| 53-89815 | 8/1978 | Japan | 420/108 |
| 908201 | 10/1962 | United Kingdom . | |
| 1216154 | 12/1970 | United Kingdom | 420/108 |
| 1425738 | 2/1976 | United Kingdom . | |
| 1441052 | 6/1976 | United Kingdom . | |

OTHER PUBLICATIONS

CIAS, Witwold W., "Phase Transformation Kinetics and Hardenability of Medium-Carbon Alloy Steels".

*Primary Examiner*—Deborah Yee

*Attorney, Agent, or Firm*—John J. Prizzi; Larry R. Meenan

[57] ABSTRACT

An air hardened steel having a reduced nickel content and acceptable impact hardness. The air hardened steel may include 0.18–0.35 w/o carbon, 1.3–1.75 w/o silicon, 1.3–2.0 w/o manganese, 0.65–2.1 w/o chromium, 0.9–2.0 w/o nickel and 0.2–0.35 w/o molybdenum and the balance impurities, deoxidants, and iron.

8 Claims, 1 Drawing Sheet

AIR HARDENING STEEL

This is a divisional of copending application Ser. No. 07/513,705 filed on Apr. 24, 1990, now U.S. Pat. No. 5,094,923.

BACKGROUND OF THE INVENTION

1. Field of the Invention

This invention relates to an air hardening steel. This invention also relates to an air hardening cast steel having a reduced nickel content and an acceptable impact toughness level.

2. Description of Related Art

Air-hardening cast steels are used in wear applications because of high hardness, excellent abrasive wear resistance and acceptable impact toughness properties. Moreover, an air-hardening cast steel can be used in the as-cast condition without the neccessity of subsequent heat treatment. Typical alloying elements known to enhance the mechanical properties of steel are chromium, carbon, manganese, molybdenum, nickel and silicon.

Manganese, chromium, molybdenum and nickel, separately or in combination, are known to have the effect of increasing hardenability. Nickel is also known to improve impact toughness. Silicon is known to effect deoxidation and improve fluidity of a molten steel thereby enhancing castability. Silicon in combination with manganese can also have the effect of increasing hardenability.

Conventional air-hardening steels contain approximately 3–6 weight percent nickel or approximately 5–12 weight percent chromium and lesser amounts of other alloying elements. Although the addition of various alloying elements in specified amounts affects the properties of the steel, it will be appreciated that the various alloying elements, and in particular nickel and/or chromium, represent a substantial contribution to the overall cost of the steel.

Accordingly, it is an object of the present invention to utilize lower percentages of nickel and/or chromium and yet maintain optimum mechanical properties in the steel. Another object of the present invention is to provide an air hardened cast steel having a carbon level of about 0.28–0.35 w/o (as used herein w/o is defined as weight percent) and having a minimal or reduced nickel content that exhibits hardness and impact toughness properties equivalent to a steel containing approximately 4 w/o nickel, 1.4 w/o chromium, 0.25 w/o molybdenum, 1 w/o silicon and 0.30–0.35 w/o carbon. Yet another object of the present invention is to provide an air-hardening cast steel having less than 4 w/o nickel that possesses hardness and impact toughness properties substantially equivalent to a steel containing approximately 4 w/o nickel.

SUMMARY OF THE INVENTION

The present invention provides an air hardened steel having a reduced nickel content and acceptable impact toughness. The air hardened steels may have a carbon concentration defined herein as from about 0.18–0.35 w/o. In one preferred embodiment of the present invention the carbon concentration is 0.18–0.23 w/o and exhibits improved impact toughness and reduced hardness properties in the air cooled condition. In yet another preferred embodiment of the present invention, the carbon concentration is 0.28–0.35 w/o and exhibits improved hardness and reduced impact toughness properties in the air cooled condition. For purposes of clarity as used herein, a carbon concentration range of 0.18–0.23 w/o and a carbon concentration range of 0.28–0.35 w/o are defined as low carbon concentration and high carbon concentration, respectively. The silicon concentration is from 1.3–1.75 w/o and most preferably, 1.5 w/o. The manganese concentration is from 1.3–2.0 w/o, preferably 1.40–2.0 w/o, more preferably 1.50–2.0 w/o, and most preferably, 1.7 w/o. The nickel concentration is from 0.90–2.0 w/o, preferably 1.0–2.0 w/o and, most preferably, 1.5 w/o.

BRIEF DESCRIPTION OF THE DRAWING

Further features and other objects and advantages of the invention will become clear from the following description made with reference to a graph, identified as FIG. 1, of mean impact toughness versus Rockwell C hardness of various steel compositions produced in accordance with the present invention (Examples 1–9) and conventional steel compositions (Examples 10–12).

DETAILED DESCRIPTION OF THE PREFERRED EMBODIMENTS

Figure 1:
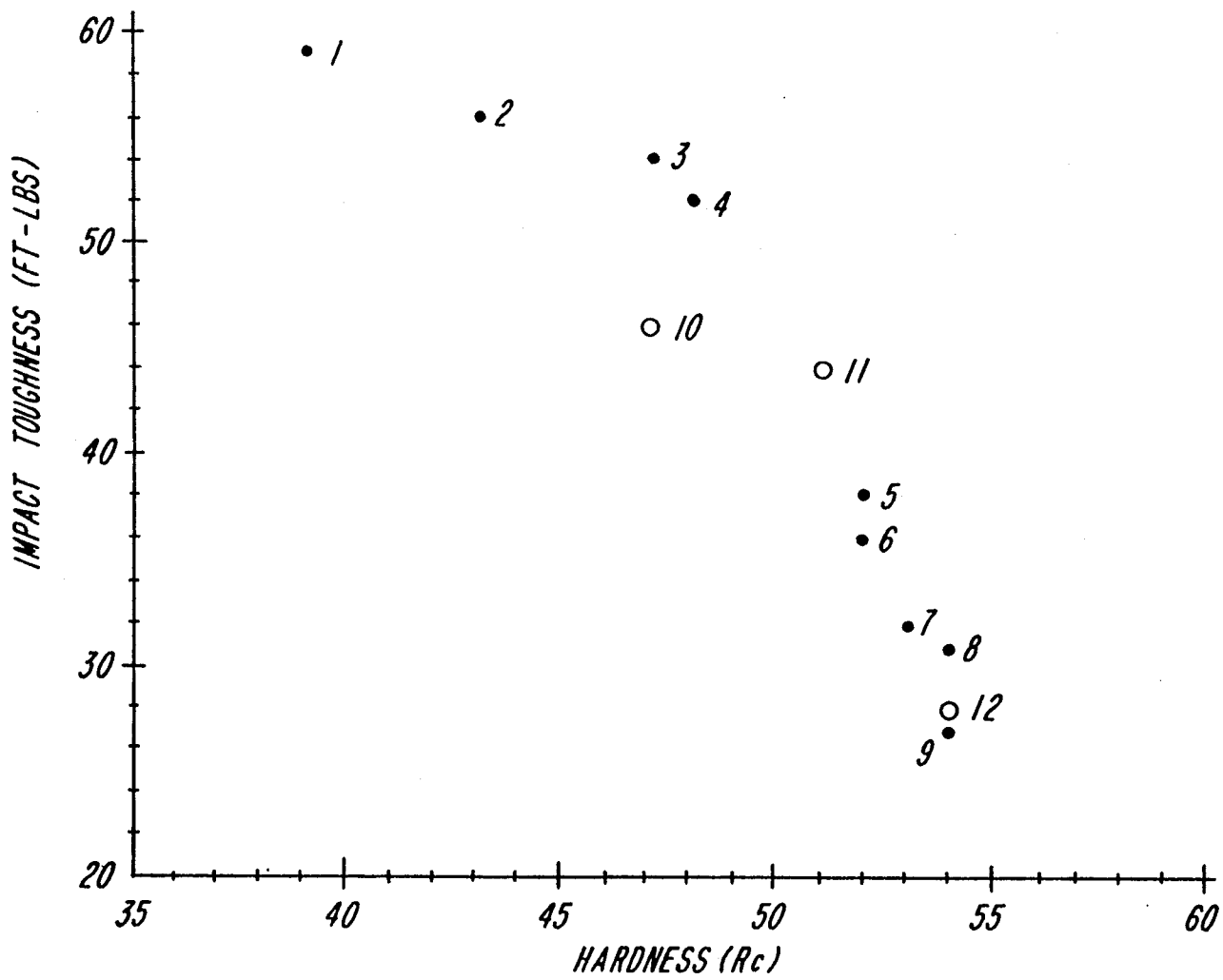

According to this invention, a steel exhibiting acceptable hardness and impact toughness is prepared generally according to standard molten steel casting procedures well known in the art.

The steels of this invention contain from 0.18 to 0.35 w/o of carbon. An amount of carbon below 0.18 w/o is insufficient to impart a martensitic structure upon cooling to provide a soft and low toughness steel and an amount of carbon above 0.35 w/o has been found to impart excessive brittleness to the steel. In a first low carbon concentration embodiment of the invention, a preferred carbon content is from 0.18–0.23 w/o. In a second high carbon concentration embodiment of the present invention, the carbon content is from 0.28–0.35 w/o.

Silicon functions as a deoxidation agent and contributes to the high hardenability of the steel. Accordingly, applicant has found that it is necessary that the silicon be present in the steels of the present invention from between 1.3–1.75 w/o and, most preferably, 1.5 w/o.

The manganese concentration in the steels of the present invention varies from 1.3–2.0 w/o, preferably 1.40–2.0 w/o, more preferably 1.50–2.0 w/o and, most preferably, 1.7 w/o. Manganese, similar to silicon, functions as a deoxidant and serves to improve the hardenability of the steels.

The nickel concentration in the steels of this invention varies from 0.90–2.0 w/o, preferably 1.0–2.0 w/o and, most preferably, 1.5 w/o.

Chromium is added to steel in order to increase its hardenability. The amount of chromium may vary from 0.65–2.1 w/o, preferably 0.8–1.8 w/o and, most preferably, 1.0 w/o. Applicant has found that by balancing the amount of nickel and chromium in the various possible combinations of steels of the present invention, acceptable levels of hardenability may be obtained at substantially low levels of Ni content.

The molybdenum concentration in the steels of this invention may vary from 0.2–0.35 w/o and is, preferably, 0.25 w/o. The molybdenum improves hardenability.

As previously set forth, the steels of this invention are air melted and refined in a conventional manner. In the melting and refining steps, it is desirable to minimize occurrence of impurities, non-metallic inclusions and the detrimental effects of dissolved gas such as oxygen and nitrogen. Thus, it is desirable that these steps be carried out while adding a deoxidation agent and/or a desulphurization agent, such as aluminum, calcium-silicon, or zirconium in suitable amounts. The molten metals of this invention may then be cast into molds to produce conventional steel castings. In yet another embodiment of the present invention, the molten steel may also be cast to form a composite wear resistant material according to the procedure described in U.S. Pat. No. 4,146,080, incorporated herein by reference. If necessary, the cast metal may then be subjected to further heat treatment to impart thereto desirable mechanical properties. The heat treatment may include austenitizing followed by hardening by cooling in air or other media such as oil and then tempering to obtain tempered martensite structures.

The steels produced in accordance with the present invention exhibit hardness and impact toughness properties substantially equivalent to an air hardened steel having a composition of approximately 4.0 w/o nickel, 1.4 w/o chromium, 0.25 w/o molybdenum and 1.0 w/o silicon. The air hardening properties of the steels of the present invention are achieved by a synergistic contribution of relatively small additions of five alloying elements: Si, Mn, Ni, Cr, and Mo. This is in contrast to conventional Ni-Cr-Mo air hardening steels in which typically Ni and/or Cr levels are specified at about 3 to 6 w/o or more.

As shown in FIG. 1, a general correlation is observed between hardness and impact toughness for air-cooled steels produced in accordance with the present invention. Both the reduced-Ni steel produced in accordance with the present invention (Examples 1–9) and the conventional 3–4 w/o Ni steel (Examples 10–12) appear to follow the same hardness-toughness relationship. Steels with increasing hardness show decreased levels of impact toughness. FIG. 1 also appears to indicate that the hardness-toughness correlation is non-linear. However, a perceived curve delineated by the Examples plotted in FIG. 1 shows a change in slope at approximately 50 $R_c$. Heats with hardness values between 51–54 $R_c$ appear to show a more marked decrease in impact toughness with increasing hardness than the Examples with hardness values between 39–48 $R_c$. Moreover, between 51–54 $R_c$, essentially the same hardness-toughness relationship exists for both the reduced-Ni steel produced in accordance with the present invention and the conventional 3–4 w/o Ni steel. Thus, a steel produced in accordance with the present invention and a steel having 3–4 w/o Ni appear to exhibit equivalent impact toughness properties in this hardness range.

At hardness values of 47–49 $R_c$, the reduced-Ni air-cooled steel produced in accordance with the present invention appears to exhibit impact toughness superior to that of an air-cooled 4 w/o Ni, 0.26 w/o C steel, as shown in FIG. 1.

At a C level of 0.18–0.23 w/o, the present invention in the air-cooled condition shows substantially equivalent hardness (39–43 $R_c$) and impact toughness properties as does a steel having a composition of approximately 4.0 w/o nickel, 1.4 w/o chromium, 0.25 w/o molybdenum, 1.0 w/o silicon, and 0.32 w/o carbon which has been slow-cooled in a mold to enhance impact toughness. Thus, the lower C steel of the present invention eliminates the need to cool a casting slowly in-mold to achieve the higher levels of impact toughness desired for certain applications.

The products according to the present invention will become more apparent upon reviewing the following detailed examples.

EXAMPLE 1

Steel bars having wear resistant tungsten carbide embedded therein were cast in accordance with the present invention. A mixture of cobalt cemented tungsten carbide particles, −1/4+4 mesh U.S. Standard Seive Series, were placed in a sand mold having multiple recesses corresponding to the desired dimensions of the castings. In this instance, the individual castings were 1 inch by 6 inch by ¾ inches thick. The amount of carbide particulate chosen was such that at least one layer of carbide particles approximately ¼ inch thick covered the bottom of each recess. The steel was melted in an induction furnace, degassed with Al and Zr, and cast at approximately 3150 degrees F. about the tungsten carbide particulate. The nominal composition of the steel was 0.20 w/o C, 1.30 w/o Si, 1.34 w/o Mn, 1.87 w/o Ni, 0.89 w/o Cr, 0.28 w/o Mo, typical impurities, and the remainder Fe. The molds containing the carbide were preheated to between 1500 and 1800 degrees fahrenheit prior to casting. After cooling for approximately one hour the castings were removed from the sand mold and allowed to cool in air to room temperature.

Hardness measurements of sections of the air cooled castings showed a mean hardness value of 39 $R_c$ as measured by standard Rockwell C testing specifications. Impact toughness was also measured by a modified Charpy-type test, ASTM Designation E23-86, on an unnotched beam of the above described sample and was found to have a mean value of 59 ft-lbs.

The impact toughness and hardness values for this steel composition are plotted on FIG. 1 and identified by the numeral 1.

EXAMPLE 2

Steel bars having wear resistant tungsten carbide embedded therein were cast in accordance with the present invention. A mixture of cobalt cemented tungsten carbide particles, −1/4+4 mesh U.S. Standard Seive Series, were placed in a sand mold having multiple recesses corresponding to the desired dimensions of the castings. In this instance, the individual castings were 1 inch by 6 inch by ¾ inches thick. The amount of carbide particulate chosen was such that at least one layer of carbide particles approximately ¼ inch thick covered the bottom of each recess. The steel was melted in an induction furnace, degassed with Al and Zr, and cast at approximately 3150 degrees F about the tungsten carbide particulate. The nominal composition of the steel was 0.21 w/o C, 1.54 w/o Si, 1.43 w/o Mn, 0.99 w/o Ni, 1.78 w/o Cr, 0.21 w/o Mo, typical impurities, and the remainder Fe. The molds containing the carbide were preheated to between 1500 and 1800 degrees fahrenheit prior to casting. After cooling for approximately one hour the castings were removed from the sand mold and allowed to cool in air to room temperature.

Hardness measurements of sections of the air cooled castings showed hardness value of 43 $R_c$ as measured by standard Rockwell C testing specifications. Impact toughness was also measured by a modified Charpy-type test, ASTM designation E23-86, on an unnotched beam of the above described sample and was found to be a mean value of 56 ft-lbs.

The impact toughness and hardness values for this steel composition are plotted on FIG. 1 and identified by the numeral 2.

EXAMPLE 3

Steel bars having wear resistant tungsten carbide embedded therein were cast in accordance with the present invention. A mixture of cobalt cemented tungsten carbide particles, −1/4+4 mesh U.S. Standard Seive Series, were placed in a sand mold having multiple recesses corresponding to the desired dimensions of the castings. In this instance, the individual castings were 1 inch by 6 inch by ¾ inches thick. The amount of carbide particulate chosen was such that at least one layer of carbide particles approximately ¼ inch thick covered the bottom of each recess. The steel was melted in an induction furnace, degassed with Al and Zr, and cast at approximately 3150 degrees F about the tungsten carbide particulate. The nominal composition of the steel was 0.30 w/o C, 1.42 w/o Si, 1.61 w/o Mn, 1.53 w/o Ni, 0.72 w/o Cr, 0.27 w/o Mo, typical impurities, and the remainder Fe. The molds containing the carbide were preheated to between 1500 and 1800 degrees fahrenheit prior to casting. After cooling for approximately one hour the castings were removed from the sand mold and allowed to cool in air to room temperature.

Hardness measurements of sections of the air cooled castings showed a mean hardness value of 47 $R_c$ as measured by standard Rockwell C testing specifications. Impact toughness was also measured by a modified Charpy-type test, ASTM Designation E23-86, on an unnotched beam of the above described sample and was found to be a mean value of 54 ft-lbs.

The impact toughness and hardness values for this steel composition are plotted on FIG. 1 and identified by the numeral 3.

EXAMPLE 4

Steel bars having wear resistant tungsten carbide embedded therein were cast in accordance with the present invention. A mixture of cobalt cemented tungsten carbide particles, −1/4+4 mesh U.S. Standard Seive Series, were placed in a sand mold having multiple recesses corresponding to the desired dimensions of the castings. In this instance, the individual castings were 1 inch by 6 inch by ¾ inches thick. The amount of carbide particulate chosen was such that at least one layer of carbide particles approximately ¼ inch thick covered the bottom of each recess. The steel was melted in an induction furnace, and degassed with Al and Zr, and cast at approximately 3150 degrees F about the tungsten carbide particulate. The nominal composition of the steel was 0.29 w/o C, 1.55 w/o Si, 1.68 w/o Mn, 1.51 w/o Ni, 0.77 w/o Cr, 0.27 w/o Mo, typical impurities, and the remainder Fe. The molds containing the carbide were preheated to between 1500 and 1800 degrees Fahrenheit prior to casting. After cooling for approximately one hour the castings were removed from the sand mold and allowed to cool in air to room temperature.

Hardness measurements of sections of the air cooled castings showed a mean hardness values of 48 $R_c$ as measured by standard Rockwell C testing specifications. Impact toughness was also measured by a modified Charpy-type test, ASTM Designation E23-86, on an unnotched beam of the above described sample and was found to be a mean value of 52 ft-lbs.

The impact toughness and hardness values for this steel composition are plotted on FIG. 1 and identified by the numeral 4.

EXAMPLE 5

Steel bars having wear resistant tungsten carbide embedded therein were cast in accordance with the present invention. A mixture of cobalt cemented tungsten carbide particles, −1/4+4 mesh U.S. Standard Seive Series, were placed in a sand mold having multiple recesses corresponding to the desired dimensions of the castings. In this instance, the individual castings were 1 inch by 6 inch by ¾ inches thick. The amount of carbide particulate chosen was such that at least one layer of carbide particles approximately ¼ inch thick covered the bottom of each recess. The steel was melted in an induction furnace, degassed with Al and Zr, and cast at approximately 3150 degrees F about the tungsten carbide particulate. The nominal composition of the steel was 0.29 w/o C, 1.45 w/o Si, 1.77 w/o Mn, 1.58 w/o Ni, 1.13 w/o Cr, 0.26 w/o Mo, typical impurities, and the remainder Fe. The molds containing the carbide were preheated to between 1500 and 1800 degrees Fahrenheit prior to casting. After cooling for approximately one hour the castings were removed from the sand mold and allowed to cool in air to room temperature.

Hardness measurements of sections of the air cooled castings showed a mean hardness value of 52 $R_c$ as measured by standard Rockwell C testing specifications. Impact toughness was also measured by a modified Charpy-type test, ASTM Designation E23-86, on an unnotched beam of the above described sample and was found to be a mean value of 38 ft-lbs.

The impact toughness and hardness values for this steel composition are plotted on FIG. 1 and identified by the numeral 5.

EXAMPLE 6

Steel bars having wear resistant tungsten carbide embedded therein were cast in accordance with the present invention. A mixture of cobalt cemented tungsten carbide particles, −1/4+4 mesh U.S. Standard Seive Series, were placed in a sand mold having multiple recesses corresponding to the desired dimensions of the castings. In this instance, the individual castings were 1 inch by 6 inch by ¾ inches thick. The amount of carbide particulate chosen was such that at least one layer of carbide particles approximately ¼ inch thick covered the bottom of each recess. The steel was melted in an induction furnace, degassed with Al and Zr, and cast at approximately 3150 degrees F about the tungsten carbide particulate. The nominal composition of the steel was 0.26 w/o C, 1.50 w/o Si, 1.45 w/o Mn, 1.08 w/o Ni, 2.00 w/o Cr, 0.32 w/o Mo, typical impurities, and the remainder Fe. The molds containing the carbide were preheated to between 1500 and 1800 degrees Fahrenheit prior to casting. After cooling for approximately one hour the castings were removed from the sand mold and allowed to cool in air to room temperature.

Hardness measurements of sections of the air cooled castings showed a mean hardness value of 52 $R_c$ as measured by standard Rockwell C testing specifications. Impact toughness was also measured by a modified Charpy-type test, ASTM Designation E23-86, on an unnotched beam of the above described sample and was found to be a mean value of 36 ft-lbs.

The impact toughness and hardness values for this steel composition are plotted on FIG. 1 and identified by the numeral 6.

EXAMPLE 7

Steel bars having wear resistant tungsten carbide embedded therein were cast in accordance with the present invention. A mixture of cobalt cemented tungsten carbide particles, −1/4+4 mesh U.S. Standard Seive Series, were placed in a sand mold having multiple recesses corresponding to the desired dimensions of the castings. In this instance, the individual castings were 1 inch by 6 inch by ¾ inches thick. The amount of carbide particulate chosen was such that at least one layer of carbide particles approximately ¼ inch thick covered the bottom of each recess. The steel was melted in an induction furnace, degassed with Al and Zr, and cast at approximately 3150 degrees F about the tungsten carbide particulate. The nominal composition of the steel was 0.29 w/o C, 1.57 w/o Si, 1.47 w/o Mn, 0.99 w/o Ni, 1.57 w/o Cr, 0.33 w/o Mo, typical impurities, and the remainder Fe. The molds containing the carbide were preheated to between 1500 and 1800 degrees Fahrenheit prior to casting. After cooling for approximately one hour the castings were removed from the sand mold and allowed to cool in air to room temperature.

Hardness measurements of sections of the air cooled castings showed a mean hardness value of 53 $R_c$ as measured by standard Rockwell C testing specifications. Impact toughness was also measured by a modified Charpy-type test, ASTM Designation E23-86, on an unnotched beam of the above described sample and was found to be a mean value of 32 ft-lbs.

The impact toughness and hardness values for this steel composition are plotted on FIG. 1 and identified by the numeral 7.

EXAMPLE 8

Steel bars having wear resistant tungsten carbide embedded therein were cast in accordance with the present invention. A mixture of cobalt cemented tungsten carbide particles, −1/4+4 mesh U.S. Standard Seive Series, were placed in a sand mold having multiple recesses corresponding to the desired dimensions of the castings. In this instance, the individual castings were 1 inch by 6 inch by ¾ inches thick. The amount of carbide particulate chosen was such that at least one layer of carbide particles approximately ¼ inch thick covered the bottom of each recess. The steel was melted in an induction furnace, degassed with Al and Zr, and cast at approximately 3150 degrees F about the tungsten carbide particulate. The nominal composition of the steel was 0.32 w/o C, 1.74 w/o Si, 1.82 w/o Mn, 1.80 w/o Ni, 1.68 w/o Cr, 0.28 w/o Mo, typical impurities, and the remainder Fe. The molds containing the carbide were preheated to between 1500 and 1800 degrees Fahrenheit prior to casting. After cooling for approximately one hour the castings were removed from the sand mold and allowed to cool in air to room temperature.

Hardness measurements of sections of the air cooled castings showed a mean hardness value of 54 $R_c$ as measured by standard Rockwell C testing specifications. Impact toughness was also measured by a modified Charpy-type test, ASTM Designation E23-86, on an unnotched beam of the above described sample and was found to be a mean value of 31 ft-lbs.

The impact toughness and hardness values for this steel composition are plotted on FIG. 1 and identified by the numeral 8.

EXAMPLE 9

Steel bars having wear resistant tungsten carbide embedded therein were cast in accordance with the present invention. A mixture of cobalt cemented tungsten carbide particles, −1/4+4 mesh U.S. Standard Seive Series, were placed in a sand mold having multiple recesses corresponding to the desired dimensions of the castings. In this instance, the individual castings were 1 inch by 6 inch by ¾ inches thick. The amount of carbide particulate chosen was such that at least one layer of carbide particles approximately ¼ inch thick covered the bottom of each recess. The steel was melted in an induction furnace, degassed with Al and Zr, and cast at approximately 3150 degrees F about the tungsten carbide particulate. The nominal composition of the steel was 0.35 w/o C, 1.64 w/o Si, 1.66 w/o Mn, 1.56 w/o Ni, 0.76 w/o Cr, 0.28 w/o Mo, typical impurities, and the remainder Fe. The molds containing the carbide were preheated to between 1500 and 1800 degrees Fahrenheit prior to casting. After cooling for approximately one hour the castings were removed from the sand mold and allowed to cool in air to room temperature.

Hardness measurements of sections of the air cooled castings showed a mean hardness value of 54 $R_c$ as measured by standard Rockwell C testing specifications. Impact toughness was also measured by a modified Charpy-type test, ASTM Designation E23-86, on an unnotched beam of the above described sample and was found to be a mean value of 27 ft-lbs.

The impact toughness and hardness values for this steel composition are plotted on FIG. 1 and identified by the numeral 9.

EXAMPLE 10

Conventional air-hardening steel bars having wear resistant tungsten carbide embedded therein were cast as described below. A mixture of cobalt cemented tungsten carbide particles, −1/4+4 mesh U.S. Standard Seive Series, were placed in a sand mold having multiple recesses corresponding to the desired dimensions of the castings. In this instance, the individual castings were 1 inch by 6 inch by ¾ inches thick. The amount of carbide particulate chosen was such that at least one layer of carbide particles approximately ¼ inch thick covered the bottom of each recess. The steel was melted in an induction furnace, degassed with Al and Zr, and cast at approximately 3150 degrees F about the tungsten carbide particulate. The nominal composition of the steel was 0.26 w/o C, 0.99 w/o Si, 0.69 w/o Mn, 3.95 w/o Ni, 0.57 w/o Cr, 0.28 w/o Mo, typical impurities, and the remainder Fe. The molds containing the carbide were preheated to between 1500 and 1800 degrees Fahrenheit prior to casting. After cooling for approximately one hour the castings were removed from the sand mold and allowed to cool in air to room temperature.

Hardness measurements of sections of the air cooled castings showed a mean hardness value of 47 $R_c$ as measured by standard Rockwell C testing specifications. Impact toughness was also measured by a modified Charpy-type test, ASTM Designation E23-86, on an unnotched beam of the above described sample and was found to have a mean value of 46 ft-lbs.

The impact toughness and hardness values for this steel composition are plotted on FIG. 1 and identified by the numeral 10.

EXAMPLE 11

Conventional air-hardening steel bars having wear resistant tungsten carbide embedded therein were cast as described below. A mixture of cobalt cemented tungsten carbide particles, −1/4+4 mesh U.S. Standard Seive Series, were placed in a sand mold having multiple recesses corresponding to the desired dimensions of the castings. In this instance, the individual castings were 1 inch by 6 inch by ¾ inches thick. The amount of carbide particulate chosen was such that at least one layer of carbide particles approximately ¼ inch thick covered the bottom of each recess. The steel was melted in an induction furnace, degassed with Al and Zr, and cast at approximately 3150 degrees F about the tungsten carbide particulate The nominal composition of the steel was 0.31 w/o C, 0.99 w/o Si, 0.83 w/o Mn, 3.40 w/o Ni, 1.23 w/o Cr, 0.26 w/o Mo, typical impurities, and the remainder Fe. The molds containing the carbide were preheated to between 1500 and 1800 degrees Fahrenheit prior to casting. After cooling for approximately one hour the castings were removed from the sand mold and allowed to cool in air to room temperature.

Hardness measurements of sections of the air cooled castings showed a mean hardness value of 51 $R_c$ as measured by standard Rockwell C testing specifications. Impact toughness was also measured by a modified Charpy-type test, ASTM Designation E23-86, on an unnotched beam of the above described sample and was found to have a mean value of 44 ft-lbs.

The impact toughness and hardness values for this steel composition are plotted on FIG. 1 and identified by the numeral 11.

EXAMPLE 12

Conventional air-hardening steel bars having wear resistant tungsten carbide embedded therein were cast as described below. A mixture of cobalt cemented tungsten carbide particles, −1/4+4 mesh U.S. Standard Seive Series, were placed in a sand mold having multiple recesses corresponding to the desired dimensions of the castings. In this instance, the individual castings were 1 inch by 6 inch by ¾ inches thick. The amount of carbide particulate chosen was such that at least one layer of carbide particles approximately ¼ inch thick covered the bottom of each recess. The steel was melted in an induction furnace, degassed with Al and Zr, and cast at approximately 3150 degrees F about the tungsten carbide particulate. The nominal composition of the steel was 0.35 w/o C, 1.09 w/o Si, 0.70 w/o Mn, 3.64 w/o Ni, 1.30 w/o Cr, 0.26 w/o Mo, typical impurities, and the remainder Fe. The molds containing the carbide were preheated to between 1500 and 1800 degrees Fahrenheit prior to casting. After cooling for approximately one hour the castings were removed from the sand mold and allowed to cool in air to room temperature.

Hardness measurements of sections of the air cooled castings showed a mean hardness value of 54 $R_c$ as measured by standard Rockwell C testing specifications. Impact toughness was also measured by a modified Charpy-type test, ASTM Designation E23-86, on an unnotched beam of the above described sample and was found to have a mean value of 28 ft-lbs.

The impact toughness and hardness values for this steel composition are plotted on FIG. 1 and identified by the numeral 12.

The patents referred to herein are hereby incorporated by reference.

Having described presently preferred embodiments of the invention, it is to be understood that the present invention may be otherwise embodied within the scope of the appended claims.

What is claimed is:

1. An air hardened steel consisting essentially of 0.28–0.32 w/o carbon, 1.3–1.75 w/o silicon, 1.3–2.0 w/o manganese, 0.65–2.1 w/o chromium, 0.9–2.0 w/o nickel and 0.2–0.35 w/o molybdenum and the balance impurities, deoxidants and iron.

2. The air hardened steel as set forth in claim 1 wherein said silicon is 1.5 w/o, said manganese is 1.7 w/o, said nickel is 1.5 w/o, said chromium is 1.0 w/o and said molybdenum is 0.25 w/o.

3. An air hardened composite article comprising a layer of wear resistant particles dispersed in a steel matrix, said steel consisting essentially of 0.28–0.32 w/o carbon, 1.3–1.75 w/o silicon, 1.3–2.0 w/o manganese, 0.65–2.1 w/o chromium, 0.9–2.0 w/o nickel and 0.2–0.35 w/o molybdenum and the balance impurities, deoxidants and iron.

4. The air hardened composite article as set forth in claim 3 wherein said silicon is 1.5 w/o, said manganese is 1.7 w/o, said nickel is 1.5 w/o, said chromium is 1.0 w/o and said molybdenum is 0.25 w/o.

5. An air hardened steel consisting essentially of 0.18–0.35 w/o carbon, 1.5 w/o silicon, 1.7 w/o manganese, 1.0 w/o chromium, 1.5 w/o nickel and 0.25 w/o molybdenum and the balance impurities, deoxidants and iron.

6. The air hardened steel as set forth in claim 5 wherein said carbon is 0.18–0.23 w/o.

7. An air hardened composite article comprising a layer of wear resistant particles dispersed in a steel matrix, said steel consisting essentially of 0.18–0.35 w/o carbon, 1.5 w/o silicon, 1.7 w/o manganese, 1.0 w/o chromium, 1.5 w/o nickel and 0.25 w/o molybdenum and the balance impurities, deoxidants and iron.

8. The air hardened steel as set forth in claim 7 wherein said carbon is 0.18–0.23 w/o.

* * * * *